US007108142B2

(12) United States Patent
Kita

(10) Patent No.: US 7,108,142 B2
(45) Date of Patent: Sep. 19, 2006

(54) RACK WITH SCREEN

(75) Inventor: Toshiyuki Kita, Osaka (JP)

(73) Assignee: OS Co., Ltd., Osaka (JP)

( * ) Notice: Subject to any disclaimer, the term of this patent is extended or adjusted under 35 U.S.C. 154(b) by 283 days.

(21) Appl. No.: 10/469,239

(22) PCT Filed: Mar. 5, 2002

(86) PCT No.: PCT/JP02/01994

§ 371 (c)(1),
(2), (4) Date: Jan. 14, 2004

(87) PCT Pub. No.: WO02/071897

PCT Pub. Date: Sep. 19, 2002

(65) Prior Publication Data

US 2004/0129660 A1 Jul. 8, 2004

(30) Foreign Application Priority Data

Mar. 6, 2001 (JP) ..... 2001-061988

(51) Int. Cl.
*A47F 5/00* (2006.01)

(52) U.S. Cl. ..... 211/180; 211/189

(58) Field of Classification Search ..... 211/180, 211/189, 186, 134; 312/3; 359/443, 461; 160/24, 127

See application file for complete search history.

(56) References Cited

U.S. PATENT DOCUMENTS 4,400,043 A * 8/1983 Rossow ..... 312/111

FOREIGN PATENT DOCUMENTS

| | | |
|---|---|---|
| JP | 63-148238 | 9/1988 |
| JP | 3-198810 | 8/1991 |
| JP | 4-21476 | 5/1992 |
| JP | 4-219997 | 8/1992 |
| JP | 2517372 | 8/1996 |
| JP | 2528187 | 12/1996 |
| JP | 11-299549 | 11/1999 |
| JP | 2000-296027 | 10/2000 |

* cited by examiner

*Primary Examiner*—Jennifer E. Novosad
(74) *Attorney, Agent, or Firm*—Armstrong, Kratz, Quintos, Hanson & Brooks, LLP

(57) ABSTRACT

In order to achieve a reduction in weight and enable swift operation of audio equipment or the like stored therein, a rack with a screen according to the present invention comprises a main body provided with shelf boards, and a screen installed so that the attitude thereof can be altered between a usage attitude in which the screen is unfurled or raised from a storage portion disposed on the upper portion or lower portion of the main body to be positioned in front of the shelf boards, and a storage attitude in which the screen is rolled from the usage attitude and stored in the storage portion.

14 Claims, 11 Drawing Sheets

(a)

(b)

RACK WITH SCREEN

TECHNICAL FIELD

The present invention relates to a rack with a screen in which various objects may be placed on one or a plurality of shelf boards, and which is appropriately provided with a screen.

BACKGROUND ART

In recent years projection screens for projecting images, or simply screens, have come to be used in homes so that larger images may be enjoyed.

Accordingly, a large number of cabinets, pieces of furniture, and the like provided with such a screen have been proposed.

Typical of these cabinets and pieces of furniture provided with a screen are large, heavy pieces such as those having upper and lower storage portions with doors, those having storage portions with doors on the left and right sides, and so on, and hence a great deal of labor is required during transportation and movement thereof. Moreover, the doors must be opened every time audio equipment and the like which is stored in the storage portions is operated, and must be closed again thereafter, and hence operation of the audio equipment is extremely troublesome.

When the doors are made of transparent glass and the audio equipment is of the type which can be operated by remote control using an infrared system remote control or the like, the equipment can be remote control-operated without opening the doors, but depending on the transparency, refractive index, and so on of the glass, the infrared rays from the remote control may not be received favorably in the light-receiving portion of the audio equipment, and hence there is room for improvement.

The present invention has been designed in consideration of the situation described above, and it is an object thereof to provide a rack with a screen in which a reduction in weight can be achieved, and in which audio equipment and the like stored therein can be operated speedily.

DISCLOSURE OF THE INVENTION

In the present invention, when a main body comprising one or a plurality of shelf boards and a screen which can be freely modified in attitude between a usage attitude in which the screen is unfurled or raised from a storage portion disposed in the upper or lower portion of the main body to be positioned in front of the shelf boards, and a storage attitude in which the screen is rolled from the usage attitude and stored in the storage portion, the screen can be set in its usage attitude by unfurling the screen downward or raising (pulling) the screen upward when the screen is rolled and stored in the storage portion disposed in the upper or lower portion of the main body. Further, by rolling up the extended screen, the screen can be rolled up and stored inside the main body. Audio equipment or the like placed on the shelf boards can be operated freely from the front side by stretching out a hand, and since there are no obstructions or the like in front, remote control audio equipment can be remote control-operated reliably using an infrared type remote control.

In the present invention, when an illuminating device for illuminating the rear of the screen is provided, no special lighting devices are required, angle adjustment of the light traveling toward the locations to be illuminated is not required, and the rear of the screen can be illuminated simply by switching the illuminating device on. By illuminating the rear of the screen in this manner, the contrast with the brightness of the screen surface can be used to view the images projected onto the screen clearly. This is supported in p67 to p68 of "Visual Perception" by Takao MATSUDA (issued by Baifukan Co., Ltd.) under the heading of "Perception of Contrast".

In the present invention, when the storage portion is provided at the upper end of the main body and the illuminating device is provided on the rear face of the storage portion, the light of the illuminating device cannot be seen directly from the front side, and special attachment members for the illuminating device are not required. In particular, by providing the illuminating device at the upper end, the rear upper end, which is positioned the furthest distance away, is illuminated such that an effective contrast with the brightness of the screen can be achieved.

In the present invention, when main body comprises: one or a plurality of carrying members constructed with a smaller front-back dimension than the front-back dimension of the shelf board in order to support the shelf board; corner supporting members formed in a substantially L-shaped form when seen from above, disposed in each of the rear side corner portions of the carrying member at both ends thereof in a left/right direction, and constituted by a rear plate portion and a side plate portion adjacent thereto on either the left or right side, the rear plate portion and side plate portion being connected so as to contact the rear face of the carrying member and the adjacent side face thereto on the left or right side; and support legs attached to the left/right pair of supporting members and comprising a base portion which contacts the ground at least further frontward than the screen, the weight applied to the shelf board can be supported securely by the carrying member, and a reduction in weight can be achieved by constituting the carrying member with a smaller front-back dimension than that of the shelf board. A further reduction in weight can be achieved by having the rear side corner portion alone supported by the corner supporting members. Moreover, since the members constituting the main body are positioned toward the rear side as described above, the center of gravity of the main body is positioned rearward of the central portion of the main body in the front-back direction, causing forward collapse of the shelf boards due to the weight of the objects placed thereon. However, this can be securely prevented by the base portion which contacts the ground frontward of the screen.

In the present invention, when the illuminating device is constituted by one or a plurality of lamps attached at predetermined intervals to the rear face of a storage case constituting the storage portion, and such that the illuminance of the lamps can be modified, images can be viewed more clearly than in the case of fluorescent lamps or the like which exhibit a flicker effect, and since the illuminance of the lamps can be adjusted according to personal preferences, differences in the distance from the wall, and so on, images can be viewed under optimal circumstances.

In the present invention, when the optical axis of the lamps is directed in a substantially horizontal direction, the rear of the screen can be illuminated by diffused light which emits weak light other than the light in the vicinity of the optical axis, which emits strong light with the greatest illuminance, and thus images can be viewed even more clearly.

In the present invention, when the storage case is constituted by a divided case which is divisible into a plurality of parts, installation and maintenance work on the screen or a screen exchange operation can be performed easily and swiftly compared to a substantially tubular storage case formed with an inlet for inserting and removing the screen.

In the present invention, when the carrying member is constituted by a frame body formed in a substantially rectangular form when seen from above having a hollow interior comprising four sides, a further reduction in weight can be achieved, and strength as a carrying member is also enhanced by constituting the carrying member in annular form.

In the present invention, when a protruding portion which protrudes outward or inward is formed on at least one of the rear plate portion and side plate portion of the corner supporting member to form an interior space over the entirety of the vertical direction thereof, an increase in strength is achieved, and the interior space formed in the protruding portion can be used as a space for providing a wiring duct to supply power to the audio equipment placed on the shelf boards, or as a space for storing a cord for the audio equipment and so on placed on the shelf boards.

In the present invention, when a fitting portion into which a rear plate can be fitted is provided on the end portion of the respective rear plate portions of the two corner supporting members, a rear plate can be attached simply by being fitted into the left and right fitting portions.

In the present invention, when an attachment portion to which a speaker can be attached is provided on the end portion of the respective side plate portions of the two corner supporting members, a speaker can be attached easily and swiftly.

In the present invention, when a space is formed in the lower portion of the main body such that a movable tray on which audio equipment is placed can be inserted therein and stored, wiring or maintenance work on the audio equipment carried on the tray can be performed easily and quickly in an open area by pulling the tray out of the main body. Moreover, following the completion of the wiring or maintenance work, the audio equipment can be inserted quickly into the space in the lower portion of the main body by moving the tray.

In the present invention, when the lower portion of the main body comprises a tray space into which two movable trays carrying audio equipment can be inserted and stored, and a speaker space in which a center speaker can be disposed between the two trays, audio equipment can be placed on the two trays in an open area by pulling the trays out of the lower portion of the main body, and wiring and maintenance work can be performed thereon easily and quickly. Following the completion of the wiring or maintenance work, the audio equipment can be inserted quickly into the space in the lower portion of the main body by moving the tray. Further, by disposing a center speaker between the trays, no special installation space need be provided, and sound and the like can be output from an optimum position in relation to the screen.

In the present invention, when the tray is constituted by a carrying portion for carrying audio equipment and a left/right pair of vertical wall portions which rise upward from the left and right end portions of the carrying portion, and the tray is provided with a concave portion on the rear face of the carrying portion into which a power outlet for the audio equipment carried on the carrying portion is embedded, the front face and rear face of the tray are both open, and thus operations (including remote control operations) from the front face of the tray, maintenance work, or wiring and maintenance work from the rear face of the tray can be performed easily. Further, by inserting a power plug of the audio equipment carried on the tray into the power outlet, trouble which occurs when a power plug attached to the distal end of a power cord of the audio equipment is inserted directly into an outlet attached to a wall, such as the power cord catching on a part of tray and becoming damaged, can be avoided.

In the present invention, when the lower end of the screen is not positioned in front of the space in the usage attitude of the screen, the audio equipment placed on the tray can be operated manually or by remote control from the front side without rolling up and storing the screen.

BEST MODE FOR CARRYING OUT THE INVENTION

An embodiment of the present invention will be described below with reference to the drawings.

Figure 1:
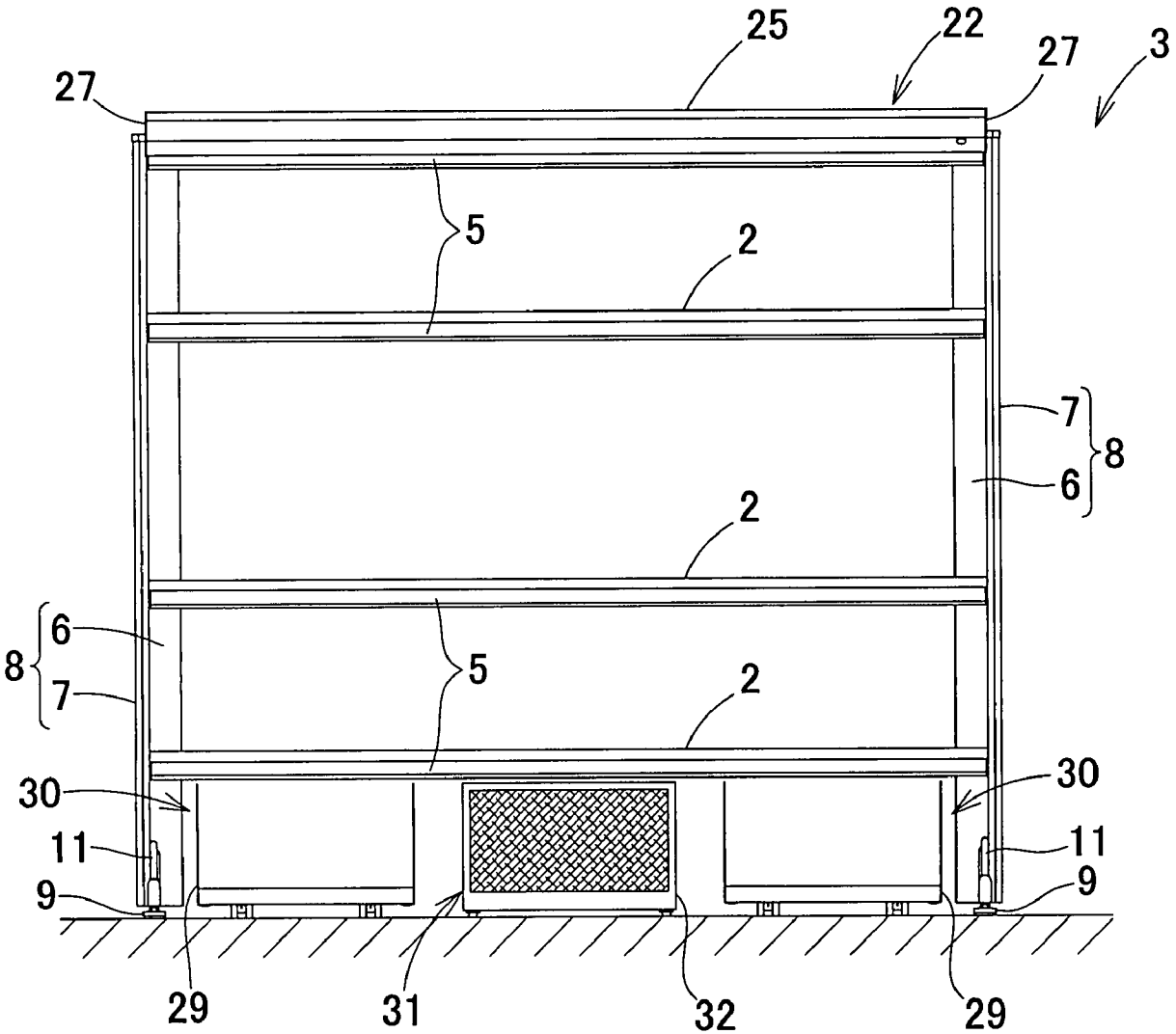
FIG. 1 is a front view of a rack with a screen in a storage attitude.
Figure 2:
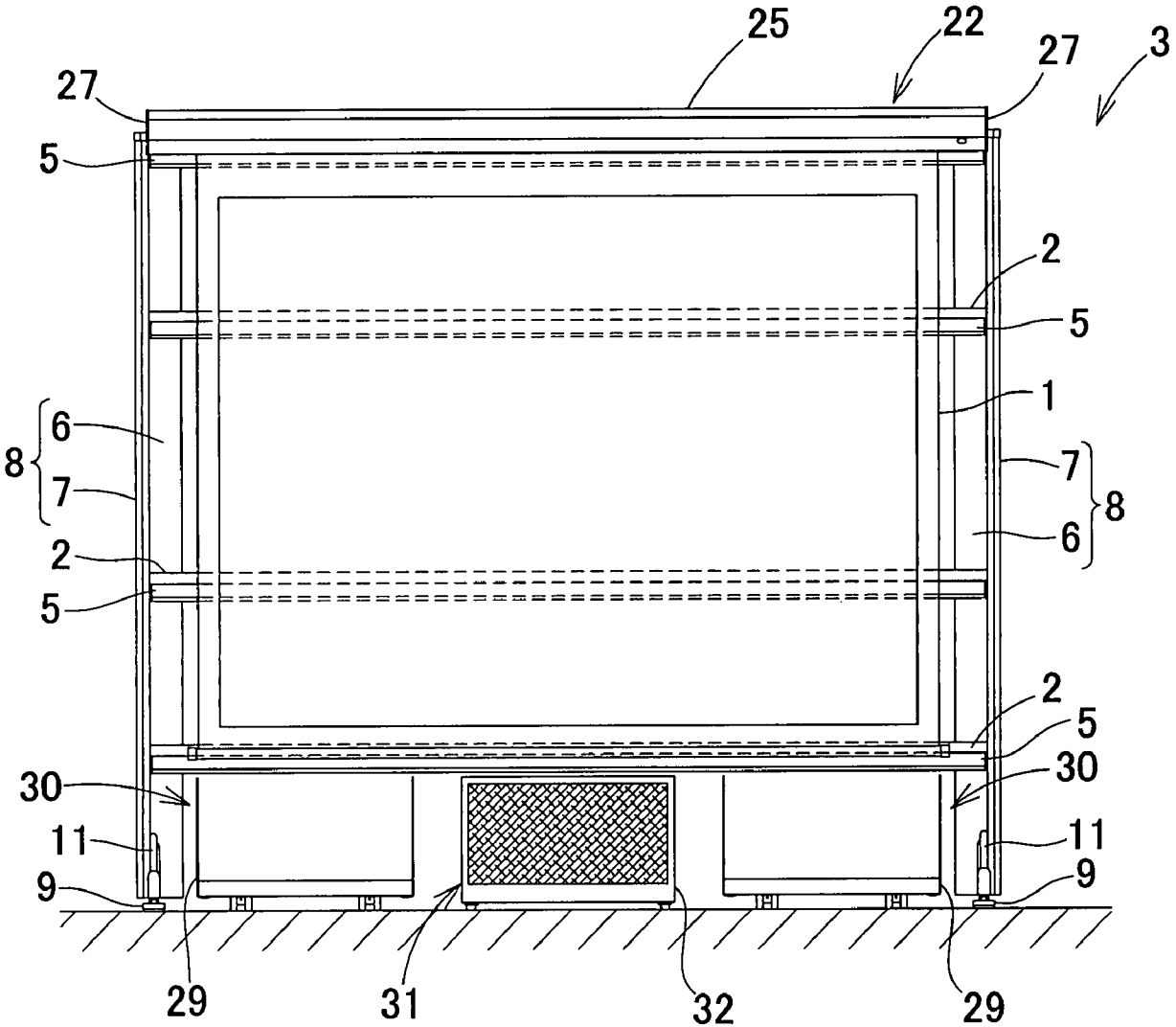
FIG. 2 is a front view of the rack with the screen in a usage attitude.
Figure 3:
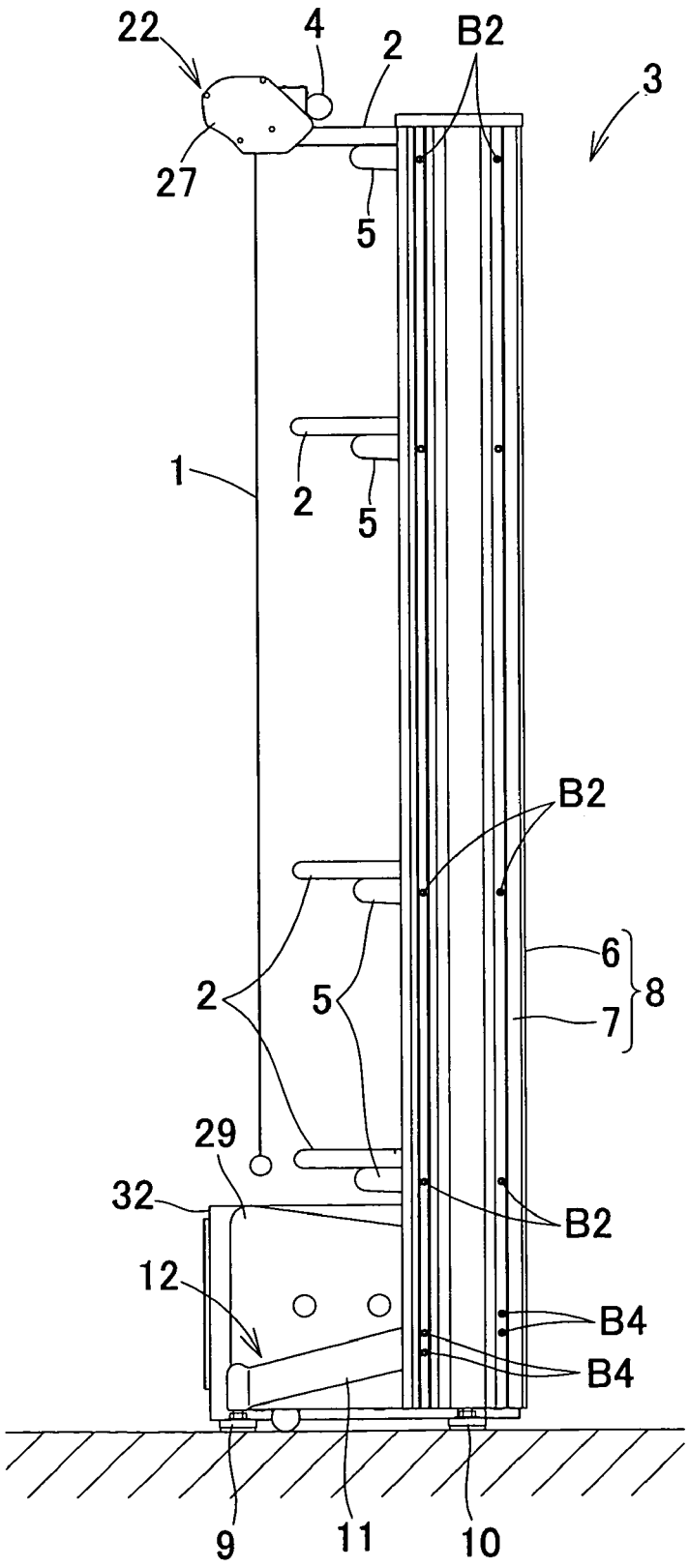
FIG. 3 is a side view of the rack with the screen in the usage attitude.

FIGS. 1 through 3 illustrate a rack with a screen (to be referred to as "rack" hereinafter) which is provided with a screen (the size (magnitude) of which may differ from that shown in the drawings) 1. This rack comprises a main body 3 provided from top to bottom with four (any plurality thereof other than one or four is also possible) rectangular wooden shelf boards 2, and four (any plurality thereof other than one or four is also possible) lamps 4 serving as an illuminating device for illuminating the rear of the main body 3. An advantage of forming the shelf boards 2 from wood is that they are lighter than metallic shelves. However, the shelf boards 2 may be constituted by any material. For example, a part or all of the shelf boards may be formed from metal, ceramics, or similar if particular reinforcement is required, or a synthetic resin may be used to achieve a further reduction in weight.

As shown in FIGS. 1 through 5, the main body 3 comprises the four shelf boards 2, four metallic carrying members 5 constructed with a smaller front-back dimension than the front-back dimension of the shelf boards 2 in order to carry and support the shelf boards 2, corner supporting members 8 (see FIGS. 9 and 10) disposed at the rear side corner portions of the carrying members 5 at each end thereof in a left/right direction, formed in a substantially L-shaped form when seen from above, and constituted by a rear plate portion 6 and a side plate portion 7 adjacent thereto on either the left or right side, the rear plate portion 6 and side plate portion 7 being connected so as to contact the rear face of the carrying member 5 and the adjacent side face thereto on either the left or right side, and support legs 12 attached to the left/right pair of supporting members 8, 8 and comprising a front side base portion 9 which contacts the ground further frontward than the screen 1 in the usage attitude, or in other words between the substantial center in the front-back direction of a storage case 22 to be described below and the front end of this storage case 22, a rear side base portion 10 which contacts the ground at a substantially central position in the front-back direction of the side plate portion 7, and a plate-form support portion 11 to which the base portions 9, 10 are attached and which is fixed to the support member 8 by screws B4. The front side base portion 9 and rear side base portion 10 are each attached to the support portion 11 by means of screwing using screws, and by rotating the base portions 9, 10, they can be moved upward or downward in respect of the support portion 11. This is advantageous in that the height at which the rack contacts the ground can be adjusted in accordance with irregularities, protrusions, and so on in the ground surface, for example. However, support legs in which ground contact height adjustment is not possible may be provided. If the support legs 12 cannot alter the ground contact height, the base portions 9, 10 and the support portion 11 may be constituted integrally. The ground contact positions of the base portions 9, 10 are advantageous in that disposing the base portions 9, 10 further to the front or rear in the front-back direction, the rack is less likely to fall over. However, in order to reduce the size of the rack, the base portions 9, 10 may be set so as not to protrude from the front end and rear end portions of the rack as shown in FIG. 3. The gap between the second and third shelf boards 2 from the bottom is set to be larger than the gap between the other shelf boards 2 so that a plasma television, liquid crystal television, or other type of display may be placed on the second shelf board 2.

Figure 6:
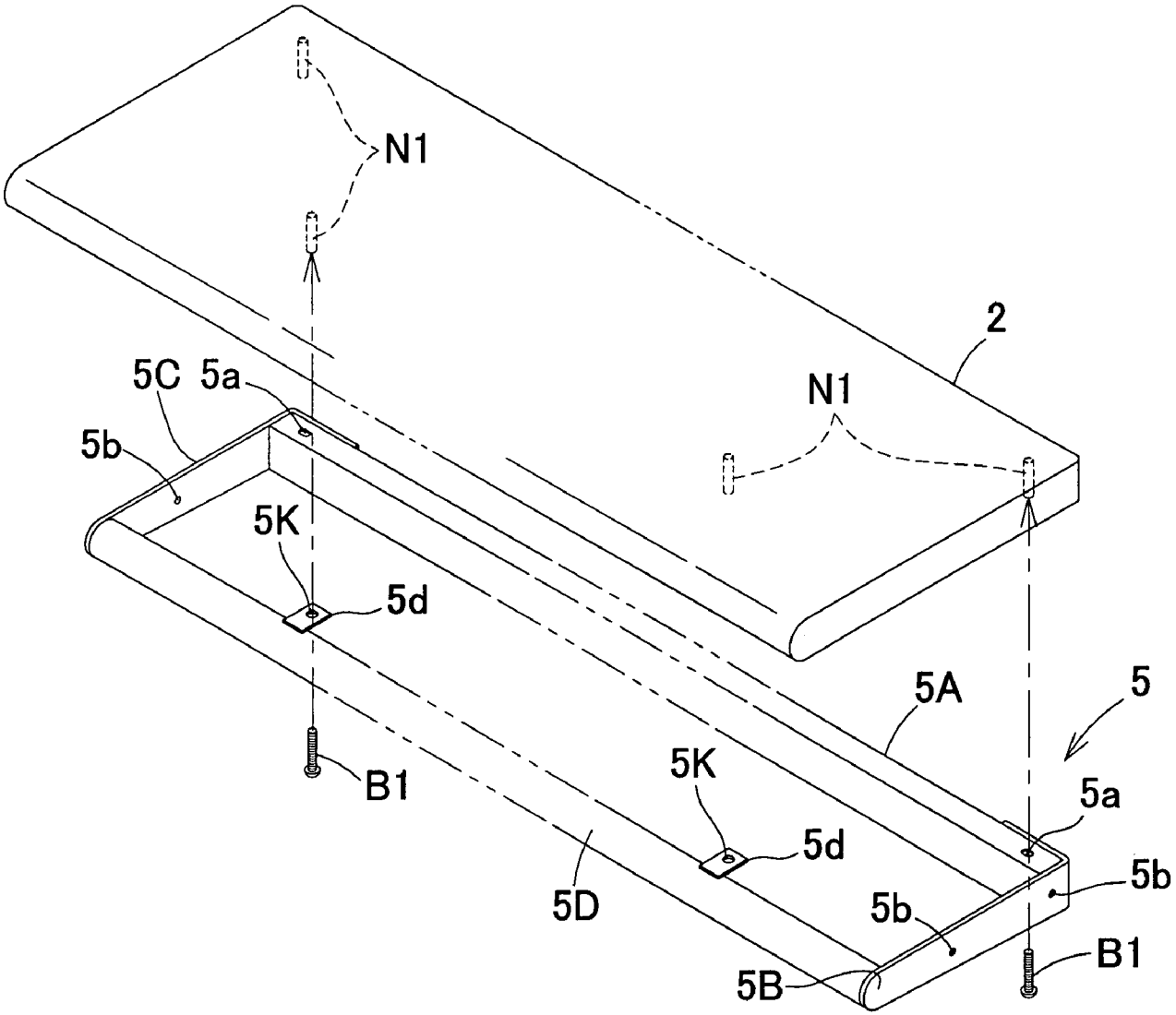
FIG. 6 is an exploded perspective view showing the attachment configuration of a shelf board and a carrying member.
Figure 11:
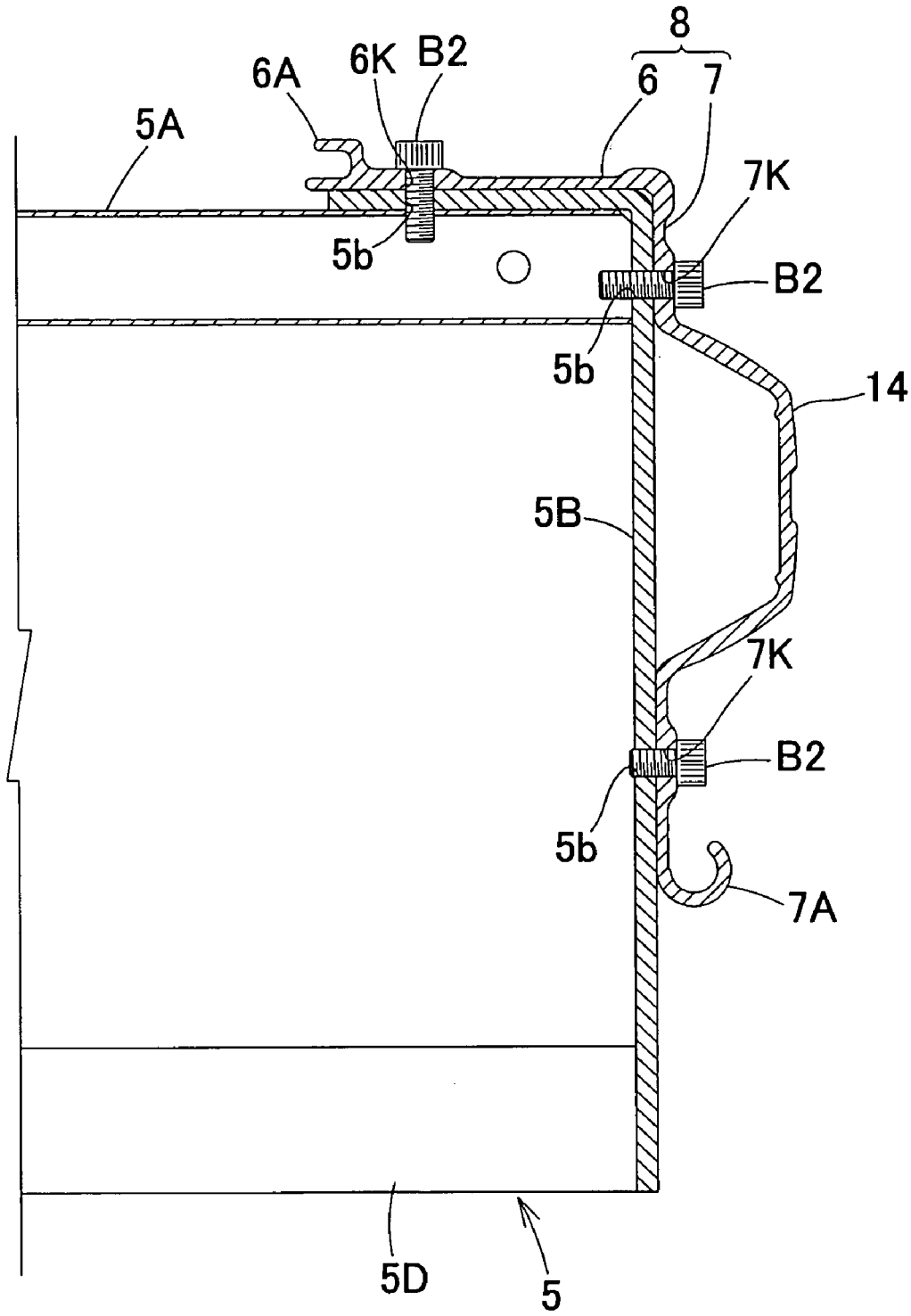
FIG. 11 is a transverse sectional plan view showing a connecting portion of the carrying member and supporting member.

As shown in FIG. 6, the carrying member 5 is constituted by a frame body with a hollow interior comprising an angled tube form rear side portion 5A, right and left L-shaped side portions 5B, 5C fixed to the two ends of the rear side portion 5A by welding or the like and bent forward therefrom at a 90° angle, and a tubular front side portion 5D which connects the front end portions of the left and right side portions 5B, 5C. Hence a reduction in weight is achieved, and the carrying member 5 can securely support heavy loads placed on the shelf boards 2 such as a plasma television (plasma display) without bending. As shown in FIG. 6, to fix the shelf board 2 to the carrying member 5, bolts B1 are screwed into four tubular nuts N1, which are buried in the shelf board 2 and formed with female screws on the inner face thereof, through holes 5K, 5K formed in brackets 5*d*, 5*d* which are fixed to the front side portion 5D and through holes 5*a*, 5*a* formed in the rear side portion 5A. The form of the carrying member 5 is not limited to that shown in FIG. 6. When fixing the carrying member 5 and supporting member 8 together, screws B2 are screwed into screw holes 5*b* formed in the carrying member 5 through through holes 6K, 7K formed in the corresponding supporting member 8, as will be described below and as is shown in FIG. 11.

Figure 4:
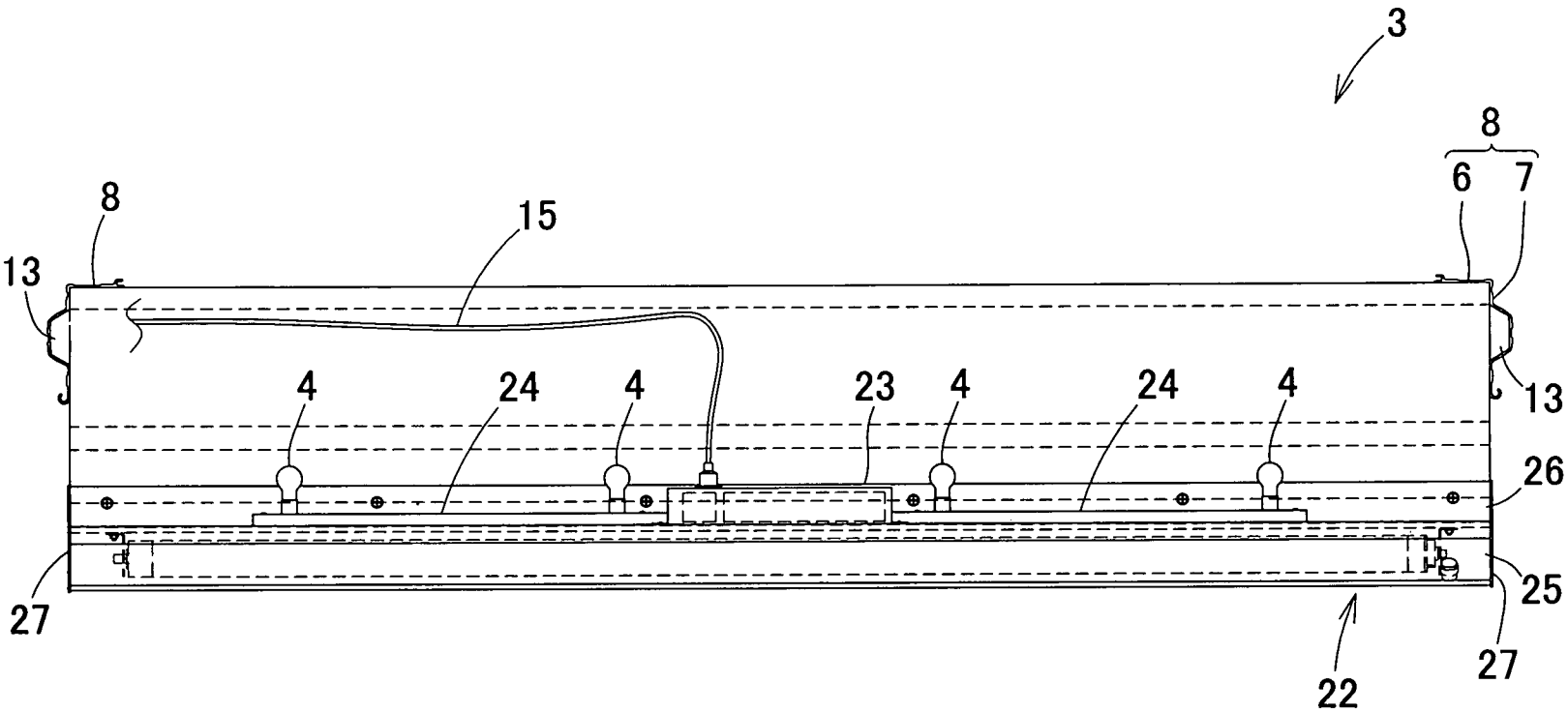
FIG. 4 is a plan view of the rack, a part of which has been omitted.
Figure 9:
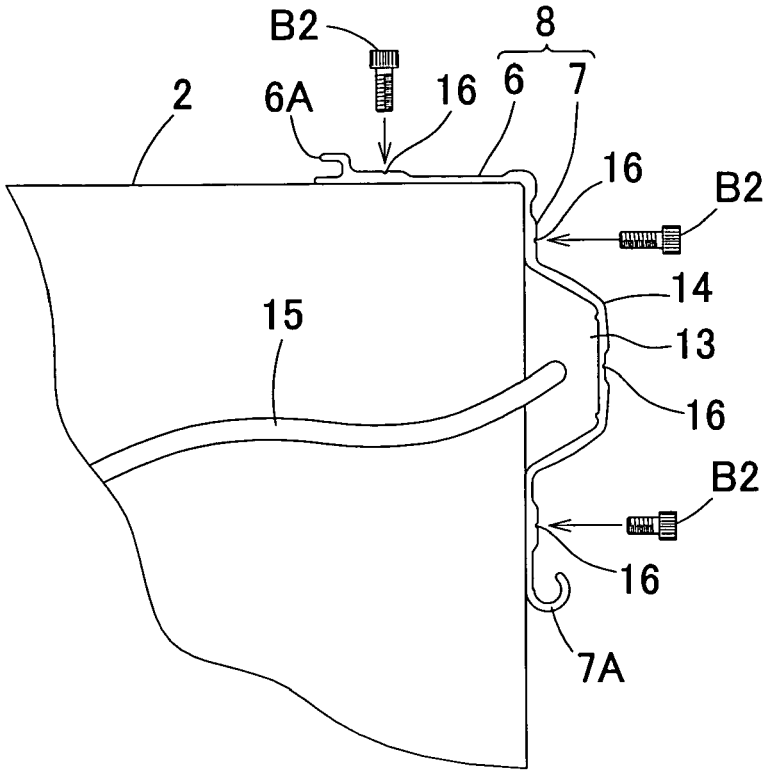
FIG. 9 is a plan view showing an attachment portion of a corner supporting member.
Figure 10:
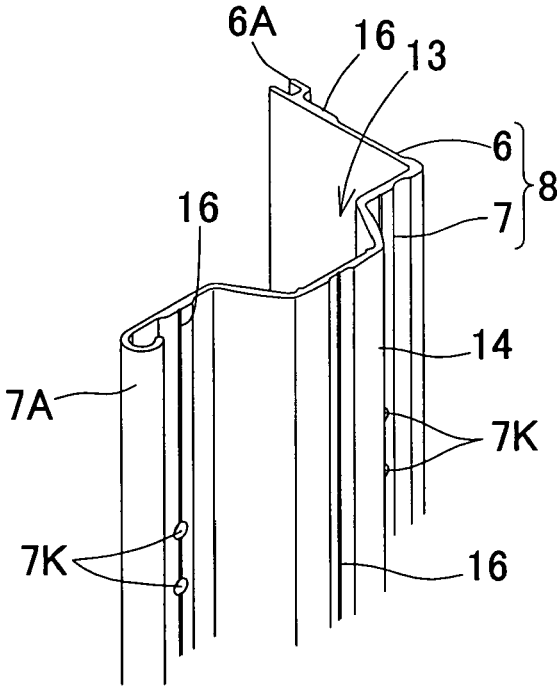
FIG. 10 is a perspective view of the corner supporting member.

As shown in FIGS. 9 and 10, the side plate portion 7 of the supporting member 8 is formed with a protruding portion 14 which protrudes outward in the front-back direction from a substantially central portion of the side plate portion 7 to form an interior space 13 which extends over the entirety of the vertical direction. This enables strength to be enhanced and also, as shown in FIG. 9, allows a cord 15 which is also illustrated in FIG. 4 to be inserted into the interior space 13 and guided downward. Since the cord 15 inserted into the interior space 13 (which is a power cord for a lamp or an electric motor for driving the screen 1, but may be a cord for another electric device placed on the shelf board 2) can be seen from the interior of the rack, a cover may be attached to the interior space 13 from the inside so that the interior space 13 cannot be seen from the interior of the rack. Alternatively, the protruding portion 14 may be caused to protrude inward. In this case, the interior space can be seen from the exterior of the rack, and hence a cover which seals the interior space from the outside may be attached. By inserting into the interior space 13 a wiring duct (also known as a power source duct) or the like for supplying a power source, which is formed as a channel and buried in the floor, for example, the power source of a plasma display or other electrical equipment placed on the shelf board 2 may be easily ensured from the wiring duct through an attachment power source plug outlet instead of using the cord 15. A plug outlet may be used in place of the wiring duct. In FIG. 9, the protruding portion 14 is formed in a substantially trapezoid form when seen from above, but may take any form such as an arc form, a rectangular form, or an angled form. In FIGS. 9 and 10, the reference numeral 16 indicates vertical positioning grooves (which are formed over the entirety of the vertical direction but may be formed partially) which are used when screws are inserted to securely position the distal end (blade tip) of an electric drill or the like used to form the screw through hole 7K and the through hole 6K shown in FIG. 11 by locking the distal end of the drill so that the distal end does not deviate from its position. The vertical grooves 16 are advantageous in that the through holes 6K, 7K may be formed securely and swiftly in the positions at which the screws B2 used to connect the carrying member 5 and supporting member 8 are inserted. However, the vertical grooves 16 may be omitted. A vertical groove 16 is also formed in the protruding portion 14 to aid in the formation of screw holes for fixing a wiring duct (plug outlet or similar) inserted into the interior space 13, but this vertical groove 16 may also be omitted.

Figure 12:
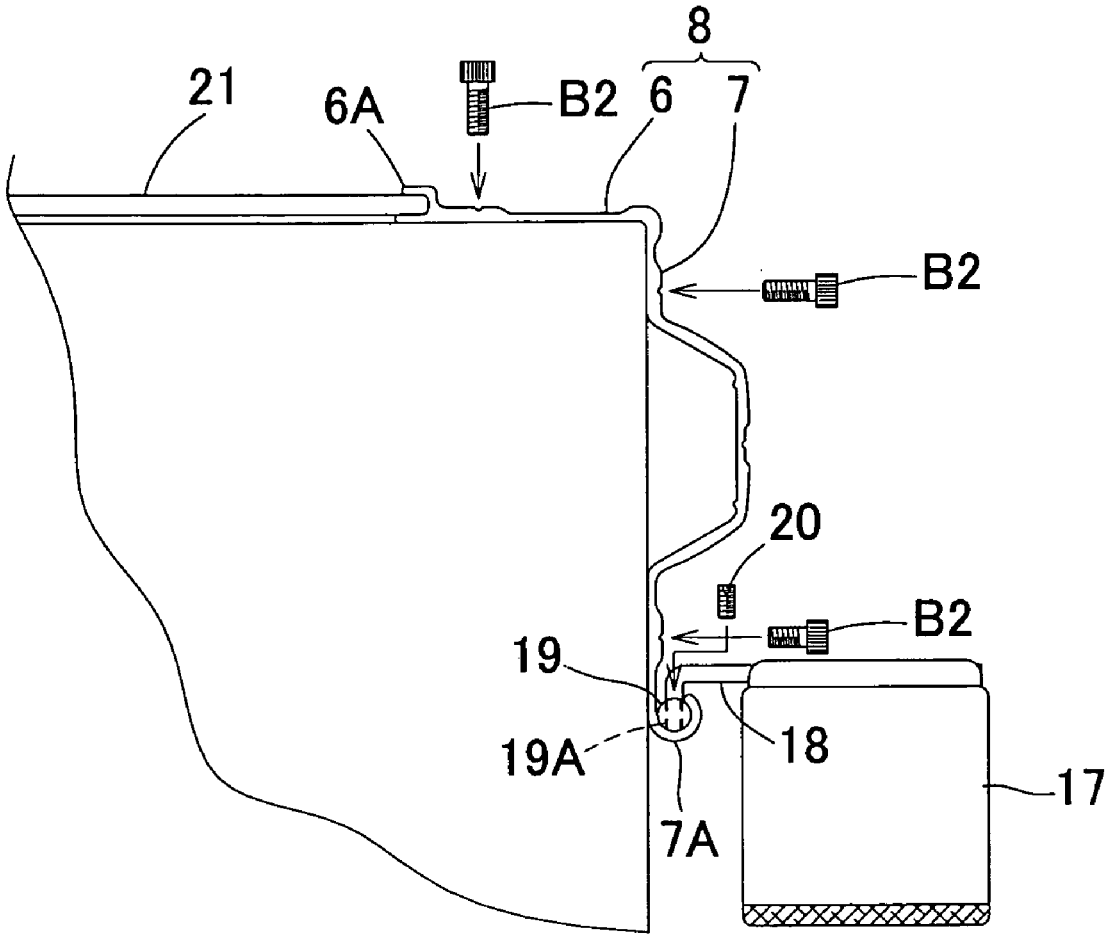
FIG. 12 is a plan view showing the main parts of the corner supporting member when provided with a speaker and a rear plate.

A curved portion 7A curved outward into arc form is provided on the end portion of the side plate portion 7, and as shown in FIG. 12, this curved portion 7A may be used as an attachment portion 7A for attaching a small speaker 17. More specifically, the distal end of a rod-form arm 18 which protrudes from the small speaker 17 is provided with a fitting portion 19 which is inserted into the attachment portion 7A, a screw portion 19A is formed in the fitting portion 19 so that a hexagon socket set screw 20 can be screwed therein, and by screwing the hexagon socket set screw 20 into the screw portion 19A such that the distal end thereof is forced to contact the inner face of the attachment portion 7A, the speaker 17 can be fixed into position. However, the speaker 17 may be fixed according to another configuration. Also, an object other than the speaker 17 may be attached via the attachment portion 7A.

As shown in FIG. 12, the end portion of the rear plate portion 6 is provided with a fitting portion 6A substantially in the form of a reverse C when seen from above into which a back board 21 may be fitted. This is advantageous in that the back board 21 can be attached easily and swiftly, but may be omitted. The remaining configurations in FIG. 12 are identical to those of FIG. 9, and hence identical reference symbols have been allocated thereto and description thereof has been omitted.

As shown in FIGS. 1 through 5, the screen 1 is rolled up and stored in the storage case 22 which is attached to the front end portion of the uppermost shelf board 2. A driving mechanism comprising an electric motor for unfurling and rewinding the screen 1 by means of electric power and power source portions, control portions, and so on for driving the electric motor is stored inside a case 23 attached to the rear face of the storage case 22 in a substantially central portion in the left/right direction. An advantage of providing the driving mechanism in this manner is that the entire rack can be made left/right symmetrical without causing the side (left or right) of the screen 1 on which the driving mechanism is provided to protrude, as occurs when the mechanism is provided at either the left or right end of the storage case 22. However, the driving mechanism may be provided at either the left or right end of the storage case 22.

The lamps 4 are attached in twos to the rear face of the storage case 22 through a plate-form attachment member 24. By lighting the rear upper end of the rack which is in the furthest position from the viewer watching the screen 1, the sharpness of the image on the screen 1 can be improved. However, the screen 1 may also be illuminated rearward and upward from the halfway point in the vertical direction. An incandescent lamp constituted by a colorless transparent glass sphere is preferable from the point of view of contrast with the image on the screen 1, but another illuminating device may be used. Further, the lamps 4 used in this case are 25 W, but lamps of any number of watts may be used. A dimming device (not shown) is provided for the lamps 4 so that the illuminance of the lamps 4 can be continuously modified (the illuminance may also be adjusted in a plurality of stages). By means of this constitution, the illuminance of the lamps 4 can be modified according to personal preferences, the distance between the rack and the wall to be illuminated, the surrounding brightness, and so on, and hence images can be enjoyed in comfort. Automatic adjustment means which adjust the illuminance of the lamps 4 automatically in accordance with the surrounding brightness may also be provided. In order to facilitate attachment of the lamps 4 and also to illuminate the rear upper end of the rack with diffused light, the optical axis 4A of the lamps 4 is directed in a substantially horizontal direction. However, the optical axis 4A may be set in an upward-inclined direction. Further, by disposing a diffusion plate (not shown) ahead of the illumination of the lamps 4, weaker and more uniform light may be irradiated onto the wall side, thereby further emphasizing contrast.

Figure 5:
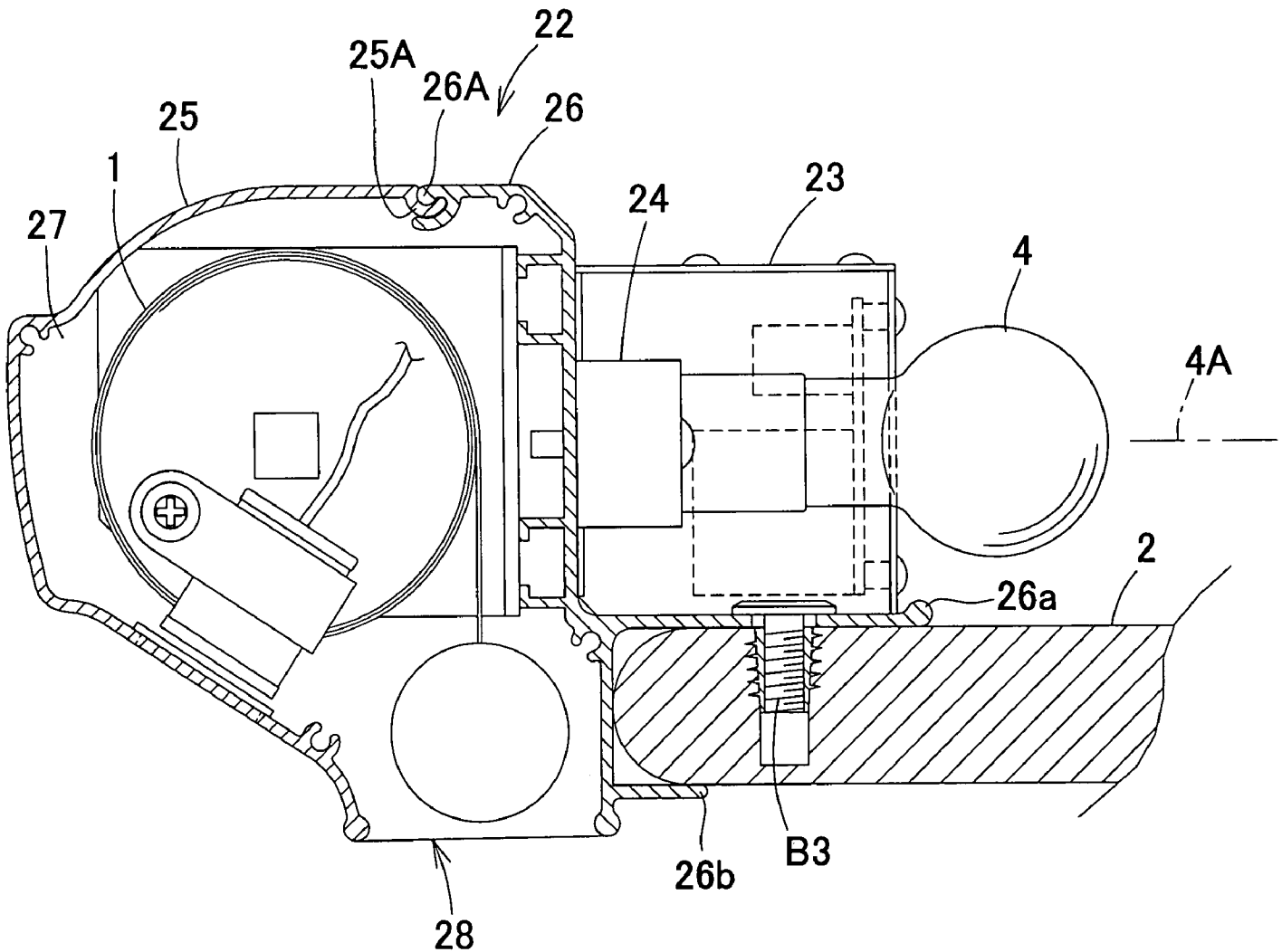
FIG. 5 is a longitudinal section showing the constitution of an attachment portion of an illuminating device.

As shown in FIGS. 4 and 5, the storage case 22 is constituted by a front side divided case 25 and a rear side divided case 26, which are divided into two in the front-back direction, a rear side case 26 comprising a latchable latched portion 26A which envelops and latches a latch portion 25A provided on the end portion of the front side divided case 25, and a lid body 27 which is screwed to the left and right end portions of the two divided cases 25, 26 to close openings on both ends of the divided cases 25, 26, and thus installation of the screen 1 in the storage case 22 and maintenance thereof can be performed easily and quickly. As shown in FIG. 5, an upper and lower pair of clamping pieces 26*a*, 26*b* is provided on the lower side of the rear side divided case 26. The front end of the highest shelf board 2 is gripped by the clamping pieces 26*a*, 26*b* and a screw B3 is used to fix the upper side clamping piece 26*a* to the shelf board 2. A gap 28 formed between the lower end of the front side divided case 25 and the lower end of the rear side case 26 serves as an inlet for the screen 1. The storage case 22 is constituted by the two divided cases 25, 26 in order to aid manufacture and assembly, but may be constituted by three or more divided cases. Further, the divided cases 25, 26 are connected by a latch, and thus assembly and disassembly of the divided cases 25, 26 may be performed swiftly. However, the divided cases 25, 26 may be connected using a screw or the like. If the divided cases 25, 26 are connected using a screw or the like, the lid body 27 may be attached to the left and right end portions of the divided cases 25, 26 by a latch.

As shown in FIGS. 1 and 2, tray spaces 30, 30 in which two trays 29, 29 constituted so as to move freely when audio equipment is placed thereon may be stored and a speaker space 31 into which a center speaker 32 can be inserted and stored between the two trays 29, 29 are formed in the lower portion of the main body, or more specifically between the lowest shelf board 2 and the floor surface. However, a space in which only one tray 29 can be stored or spaces in which three or more trays 29 can be stored may be formed. In FIGS. 1 and 2, the three spaces 30, 30, 31 are constituted by a single space, but may be constituted by three spaces using partition plates or the like.

By disposing the screen 1 such that the lower end position of the screen 1 in its usage attitude is not lower than the lowest shelf board 2, the audio equipment placed on the trays 29, 29 may be operated manually or by remote control, and the trays 29, 29 may be pulled forward or pushed inward. Furthermore, the sound from the center speaker 32 is not obstructed by the screen 1 and can be outputted in a real fashion from the substantial center of the screen 1 in the left/right direction.

Figure 7:
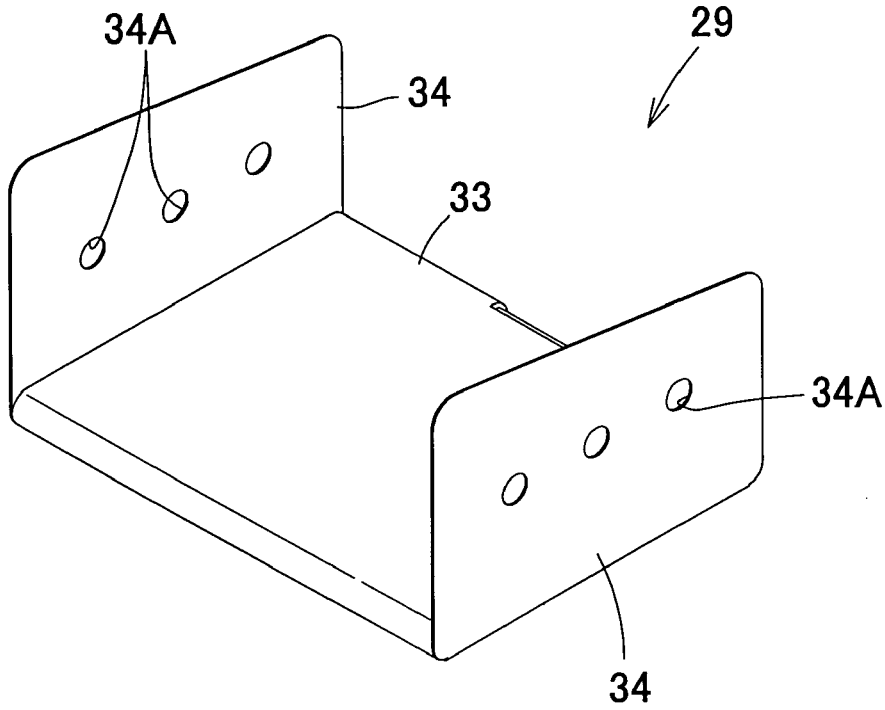
FIG. 7 illustrates a tray, (a) being a perspective view thereof and (b) being a back view thereof.
Figure 7:
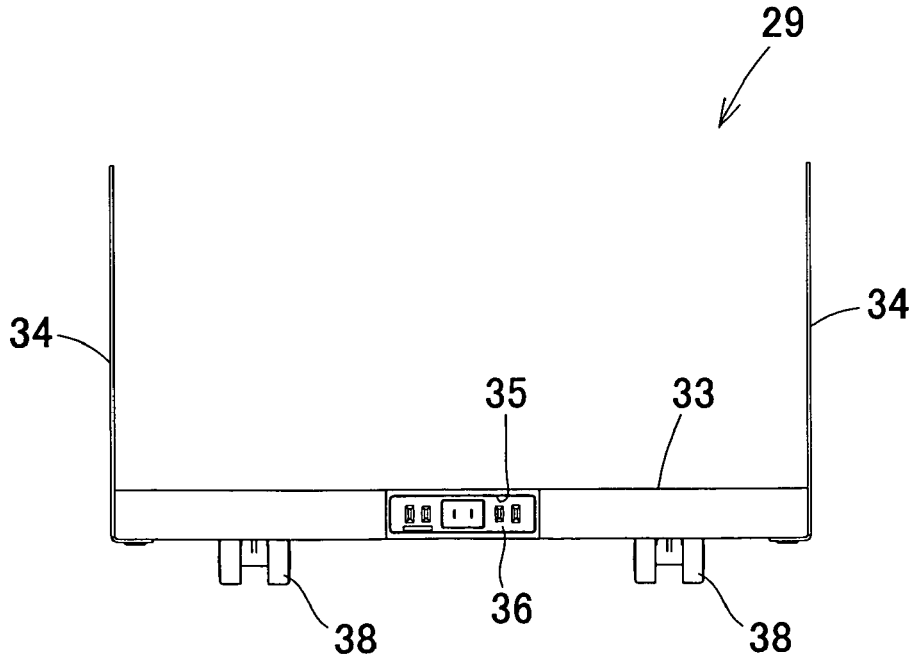
Figure 8:
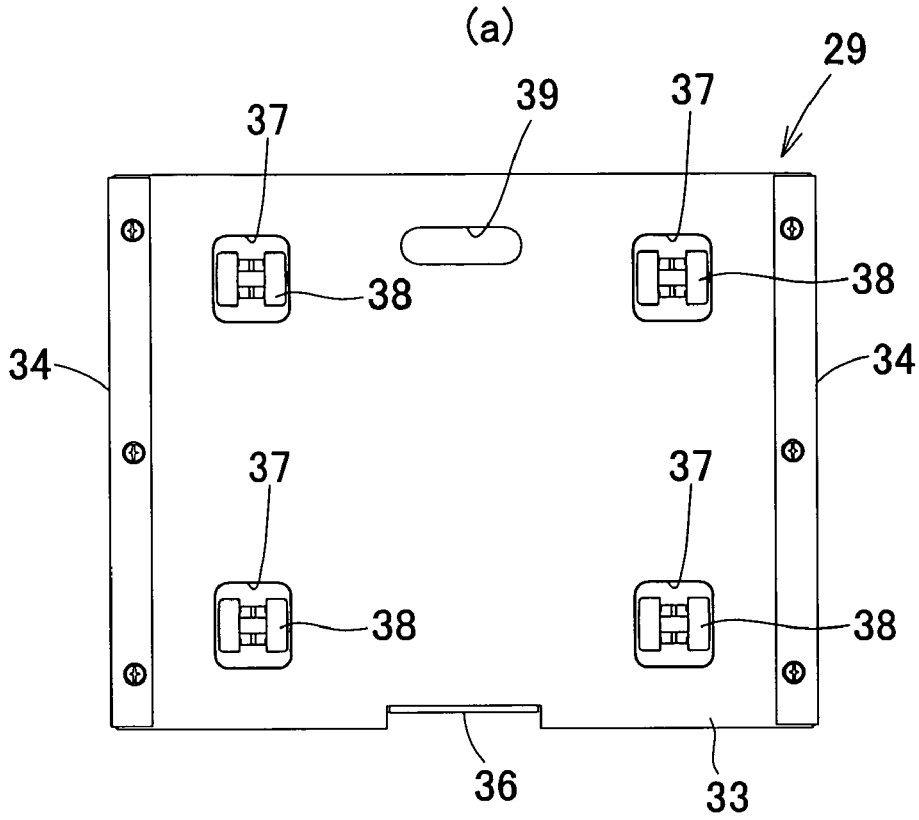
FIG. 8 illustrates the tray, (a) being a bottom view thereof and (b) being a longitudinal sectional side view thereof.
Figure 8:
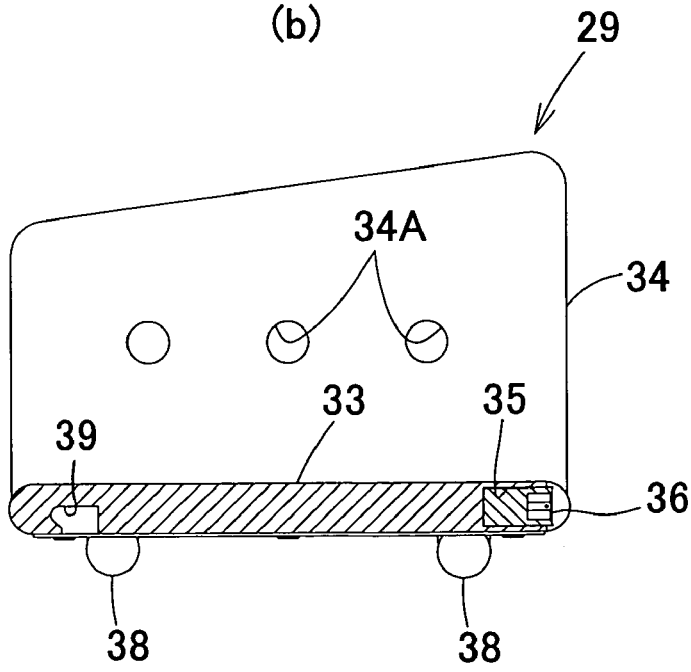

The two trays 29, 29 have an identical constitution, and hence one of the trays 29 will be described. As shown in FIGS. 7(*a*), (*b*) and 8(*a*), (*b*), the tray 29 comprises a plate-form carrying portion 33 made of wood on which audio equipment is placed, and a left/right pair of metallic plate-form vertical wall portions 34 which rise upward from the left and right end portions of the carrying portion 33. The vertical wall portions 34 each have a horizontal portion which is formed by folding the lower ends thereof in a horizontal direction and screwed to the lower face of the carrying portion 33. The reference symbol 34A in the drawings indicates three holes formed in the vertical wall portions 34, but these holes 34A may be omitted.

A concave portion 35 recessed toward the front side is formed on the rear face of the carrying portion 33, and an audio equipment power outlet (in the drawing, two plug holes are provided for the two pieces of audio equipment that can be carried on the trays, but one, three, or more plug holes may be provided) 36 is embedded therein so that the power cords of the audio equipment are not positioned on the exterior of the trays 29. Substantially rectangular concave portions 37 recessed upward are formed in two locations, on the left and right side, of the front side and rear side respectively on the lower face of the carrying portion 33, and non-direction changing casters 38 (constituted with rollers that are attached so as to be rotatable only along a left/right horizontal axis) are attached to each of the four concave portions 37, thereby making the gap between the floor surface and the carrying portion 33 as small as possible and allowing easy handling of the trays 29 which can only move forward and backward, in contrast to a case in which direction-changing casters are attached such that the trays 29 move unexpectedly. However, direction-changing casters may be attached to the tray 29. A concave portion 39 into which a hand can be inserted is also formed on the lower face of the carrying portion 33 in a substantially central position between the left and right ends of the front side, thereby enabling the tray 29 to be easily moved and manipulated by a hand inserted into the concave portion 39. Alternatively, a handle or the like which protrudes slightly frontward may be attached to the front face of the carrying portion 33.

To describe the usage of the screen 1 on the rack constituted as described above, first a down button of a remote control is pressed, whereby an electric motor (not shown) is driven and the screen 1 is unfurled downward from the storage case 22 into its usage attitude. By simultaneously pressing a lighting button on the remote control, or automatically in conjunction with the down button, the lamps 4 are illuminated. If modifications are to be made to the illuminance of the lamps 4 at this time, a modification button provided on the remote control may be operated. The screen 1 may be held in any unfurled position. When returning the screen 1 to its storage attitude, an up button is pressed on the remote control, whereby the electric motor (not shown) is caused to rotate in the opposite direction to the previous rotation direction. The screen 1 can then be rolled up into its storage attitude inside the storage case 22.

In the rack described above, the screen 1 is unfurled into its usage attitude from top to bottom, but the screen 1 may be raised into its usage attitude from bottom to top. In this case, a pantographic link mechanism (not shown) or the like is required so that the screen 1 can be placed in its usage attitude smoothly, and so that the usage attitude can be maintained. Further, the screen 1 may be placed in its usage attitude and storage attitude using human power (manually) rather than electrical power.

INDUSTRIAL APPLICABILITY

According to the present invention, a rack with a screen is constituted from a main body comprising shelf boards, and thus a reduction in weight is achieved in comparison to conventional storage units with doors. Moreover, audio equipment or the like which is placed on the shelf boards can be operated freely from the front side thereof by stretching out a hand, and since there are no obstructions in front, remote control audio equipment can be remote control-operated reliably using an infrared type remote control. Hence, a superior rack from the point of view of handling can be provided.

In the present invention, the illuminating device is provided to illuminate the rear of the screen, and thus no special lighting equipment needs to be installed. Moreover, angle adjustment of the light traveling toward the location to be illuminated is not required, and the rear of the screen can be illuminated simply by switching the illuminating device on. As a result, images projected onto the screen can be viewed clearly, total costs can be reduced, and handling can be simplified.

In the present invention, the storage portion provided at the upper end is used effectively to house the illuminating device, and thus the storage device serves as a light-shielding member such that the light from the illuminating device cannot be seen directly from the front side thereof. Hence no special attachment members are required for the illuminating device, which is advantageous in terms of cost. In particular, by providing the illuminating device at the upper end, the rear side of the upper end of the rack, which is furthest away in terms of distance, is illuminated, and thus the contrast between the illuminating device and the brightness of the screen surface is used effectively to benefit the user.

According to the present invention, weight applied to the shelf boards can be reliably supported by the carrying members, and since the front-back dimension of the carrying members is smaller than that of the shelf boards, a reduction in weight can be achieved which is advantageous from the point of view of handling. A further reduction in weight can be achieved due to the corner supporting members which support only the rear side corner portions, and forward collapse of the shelf boards due to the center of gravity of the objects placed thereon being further toward the central portion of the main body in the front-back direction than the rearward positioned center of gravity of the main body can be securely prevented by the base portion which contacts the ground frontward of the screen. Hence the rack of the present invention is superior in terms of both reduced weight and product reliability.

In the present invention, the illuminating device is constituted by one or a plurality of lamps attached at predetermined intervals to the rear face of the storage case which serves as the storage portion, and the illuminance of the lamps is modifiable. Hence images can be viewed more clearly than in the case of fluorescent lamps or the like which exhibit a flicker effect. Since the illuminance of the lamps can be adjusted according to personal preferences, differences in the distance from the wall, and so on, images can be viewed under optimal circumstances, and thus the rack achieves a high standard of finishing.

In the present invention, the optical axis of the lamps is directed in a substantially horizontal direction, and thus the rear of the screen can be illuminated by diffused light which emits weak light other than the light in the vicinity of the optical axis, which emits strong light with the greatest illuminance. As a result, images can be viewed even more clearly.

In the present invention, the storage case is constituted by a divided case which is divisible into a plurality of parts. Hence, compared to a substantially tubular storage case formed with an inlet for the screen, installation and maintenance work on the screen or a screen exchange operation can be performed easily and swiftly, which is advantageous in terms of labor.

In the present invention, the carrying member is constituted by a frame body formed in a substantially rectangular form when seen from above with a hollow interior and four sides, thus enabling a further reduction in weight. Strength as a carrying member is also enhanced by constituting the carrying member in annular form, and a reduction in the weight of the entire rack can also be achieved.

In the present invention, at least one of the rear plate portion and side plate portion of the corner supporting member is formed with a protruding portion which protrudes outward or inward to form an interior space over the entirety of the vertical direction. Thus an increase in strength is achieved, weight is further reduced, and the interior space formed in the protruding portion can be used conveniently as a space for providing a wiring duct or the like to supply power to the audio equipment placed on the shelf boards, or as a space for storing a cord for the audio equipment and so on placed on the shelf boards.

In the present invention, a fitting portion into which a rear plate can be fitted is provided on the end portion of each rear plate portion of the two corner supporting members. Thus a rear plate can be attached simply by being fitted into the left and right fitting portions, which is advantageous from the point of view of assembly work.

In the present invention, an attachment portion to which a speaker can be attached is provided on the end portion of each side plate portion of the two corner supporting members. Thus a speaker can be attached easily and swiftly such that the system can be set up simply.

In the present invention, a space into which a movable tray for carrying audio equipment can be inserted and stored is formed in the lower portion of the main body. This is convenient and useful in that wiring or maintenance work on the audio equipment carried on the tray can be performed easily and quickly in an open area by pulling the tray out of the main body.

In the present invention, tray spaces into which two movable trays for carrying audio equipment can be inserted and stored and a speaker space in which a center speaker can be disposed between the two trays are formed in the lower portion of the main body. This is convenient and useful in that audio equipment can be placed on the two trays in an open area by pulling the trays out of the lower portion of the main body, and wiring and maintenance work can be performed thereon easily and quickly. Further, by disposing a center speaker between the trays, no special installation space need be provided, and sound can be output from an optimum position in relation to the screen. As a result, the value of the rack with a screen can be increased.

In the present invention, the tray is constituted by a carrying portion on which audio equipment is carried and a left/right pair of vertical wall portions which rise upward from the left and right end portions of the carrying portion, and a concave portion for inserting a power outlet for the audio equipment placed on the carrying portion is formed on the rear face of the carrying portion. Thus operations (including remote control operations) from the front face of the tray, maintenance work, or wiring and maintenance work from the rear face of the tray can be performed easily, which is advantageous in terms of usability. Further, by inserting a power plug of the audio equipment carried on the tray into the power outlet, trouble which occurs when a power plug attached to the distal end of a power cord of the audio equipment is inserted directly into an outlet attached to a wall, such as the power cord catching on a part of tray and becoming damaged, can be avoided, and thus usage is favorable.

When the screen is in its usage attitude, the lower end of the screen is not positioned in front of the space, and thus the audio equipment placed on the tray can be operated manually or by remote control from the front side without rolling up and storing the screen. Hence, the rack is even more convenient for use.

The invention claimed is:

1. A rack with a screen comprising:

a main body comprising one or a plurality of shelf boards; and a screen which can be freely modified in attitude between a usage attitude in which said screen is unfurled or raised from a storage portion disposed at the upper portion or the lower portion of said main body to be positioned in front of said shelf boards, and a storage attitude in which said screen is rolled from said usage attitude and stored in said storage portion, wherein said main body comprises:

one or a plurality of carrying members constructed with a smaller front-to-back dimension than the front-to-back dimension of said shelf board in order to support said shelf board, said carrying member is constituted by a frame body formed in a substantially rectangular form, when seen from above, having a hollow interior with four sides;

corner supporting members formed in a substantially L-shaped form when seen from above, disposed in each of a rear side corner portion of said carrying member at both ends thereof in a left to right direction, and having a rear plate portion and a side plate portion adjacent thereto on either the left or right side of the corner supporting members, said rear plate portion and said side plate portion being connected so as to contact a rear face of said carrying member and an adjacent side face of said carrying member on either the left or right side; and support legs attached to a left to right pair of supporting members and comprising a base portion which contacts the ground at least further forward than said screen.

2. The rack with a screen according to claim 1, comprising an illuminating device for illuminating the rear of said screen.

3. The rack with a screen according to claim 2, wherein said storage portion is provided at the upper end of said main body, and said illuminating device is provided on the rear face of said storage portion.

4. The rack with a screen according to claim 3, wherein said illuminating device is constituted by one or a plurality of lamps attached at predetermined intervals to the rear face of a storage case constituting said storage portion, and such that the illuminance of said lamps can be modified.

5. The rack with a screen according to claim 4, wherein the optical axis of said lamps is directed in a substantially horizontal direction.

6. The rack with a screen according to claim 1, further comprising a storage case which is constituted by a divided case which is divisible into a plurality of parts.

7. The rack with a screen according to claim 1, wherein said carrying member is constituted by a frame body formed in a substantially rectangular form when seen from above having a hollow interior with four sides.

8. The rack with a screen according to claim 1, wherein a protruding portion which can protrude both outwardly and inwardly is formed on at least one of the rear plate portion and side plate portion of said corner supporting member to form an interior space over the entirety of the vertical direction thereof.

9. The rack with a screen according to claim 1, wherein a fitting portion into which a rear plate can be fitted is provided on an end portion of the respective rear plate portions of two corner supporting members.

10. The rack with a screen according to claim 1, wherein an attachment portion to which a speaker can be attached is provided on an end portion of the respective side plate portions of two corner supporting members.

11. The rack with a screen according to claim 1, wherein a space is formed in a lower portion of said main body such that a movable tray on which audio equipment is placed is inserted and stored therein.

12. The rack with a screen according to claim 1, wherein tray spaces into which two movable trays for carrying audio equipment inserted and stored, and a speaker space in which a center speaker can be disposed between the two trays are formed in a lower portion of said main body.

13. The rack with a screen according to claim 11 or 12, wherein said tray is constituted by a carrying portion for carrying audio equipment and a left to right pair of vertical wall portions which rise upward from left and right end portions of said carrying portion, and is provided with a concave portion formed on a rear face of said carrying portion into which a power outlet for the audio equipment carried on said carrying portion is embedded.

14. The rack with a screen according to claim 11 or 12, wherein a lower end of said screen is not positioned in front of said space when in the usage attitude of said screen.

* * * * *